US008201797B2

(12) United States Patent
Figueras Mitjans

(10) Patent No.: US 8,201,797 B2
(45) Date of Patent: Jun. 19, 2012

(54) STATIONARY ANCHORING FOOT FOR CHAIRS POSITIONED AT DESKS

(75) Inventor: Jose Figueras Mitjans, Barcelona (ES)

(73) Assignee: Figueras International Seating, S.A., Barcelona (ES)

( * ) Notice: Subject to any disclaimer, the term of this patent is extended or adjusted under 35 U.S.C. 154(b) by 366 days.

(21) Appl. No.: 12/450,068

(22) PCT Filed: Mar. 13, 2008

(86) PCT No.: PCT/ES2008/000138

§ 371 (c)(1),
(2), (4) Date: Sep. 10, 2009

(87) PCT Pub. No.: WO2008/113876

PCT Pub. Date: Sep. 25, 2008

(65) Prior Publication Data

US 2010/0090511 A1 Apr. 15, 2010

(30) Foreign Application Priority Data

Mar. 22, 2007 (ES) ..... 200700758

(51) Int. Cl.
*F16M 13/00* (2006.01)

(52) U.S. Cl. ..... 248/416; 248/417

(58) Field of Classification Search ..... 248/188, 248/188.1, 415, 416, 417; 297/344.14
See application file for complete search history.

(56) References Cited

U.S. PATENT DOCUMENTS

| | | | | |
|---|---|---|---|---|
| 1,774,950 | A | 9/1930 | Squires | |
| 1,895,226 | A | 1/1933 | Kupski | |
| 3,385,550 | A | 5/1968 | Doerner | |
| 3,837,611 | A | 9/1974 | Rhoades | |
| 4,872,635 | A | 10/1989 | Knoblock | |
| 5,131,718 | A * | 7/1992 | Cooper | 297/452.1 |
| 6,106,064 | A | 8/2000 | Hibberd | |
| 6,315,262 | B1 | 11/2001 | Hur | |
| 6,352,308 | B1 * | 3/2002 | Chen | 297/344.21 |
| 2007/0035164 | A1 * | 2/2007 | North | 297/217.1 |

FOREIGN PATENT DOCUMENTS

| | | | |
|---|---|---|---|
| CH | 332426 | A | 9/1958 |
| DE | 2106463 | A1 | 8/1972 |
| DE | 3246378 | A1 | 7/1983 |
| FR | 2861266 | A1 | 4/2005 |
| GB | 632473 | A | 11/1949 |

* cited by examiner

*Primary Examiner* — Ramon Ramirez
(74) *Attorney, Agent, or Firm* — The Nath Law Group; Jerald L. Meyer; Robert T. Burns

(57) ABSTRACT

The invention relates to an anchoring foot for chairs positioned at desks, comprising a column (1) having a lower anchor (2) for securing same to the ground and an upper supporting element (3), rotatably coupled thereto, for securing the body of the chair (13). The supporting element (3) includes a carriage (7) which can move longitudinally along a guide (8) forwards and backwards in relation to the desk (17) and which can rotate in relation to the column (1). In addition, the supporting element (3) can include a lower cam (25) positioned facing another complementary upper cam (22) that is inserted therein by means of helical tracks (24). The lower cam (25) is pushed upwards by the return force of a spring (27), thereby rotating the upper cam (22) and rotating the seat to the initial position thereof.

6 Claims, 13 Drawing Sheets

STATIONARY ANCHORING FOOT FOR CHAIRS POSITIONED AT DESKS

This is a National Phase Application filed under 35 U.S.C. §371 as a national stage of PCT/ES2008/000138, with the filing date of Mar. 13, 2008, which claims priority to Spanish application P 2007 00758, with the filing date of Mar. 22, 2007, both of which are hereby incorporated by reference in their entirety.

FIELD OF THE ART

The present invention relates to the stationary anchoring arrangement of chairs positioned at work desks, proposing a supporting foot for supporting the chairs in said arrangement, which allows a movement of the corresponding chair in order to be able to enter and exit between the chair and the desk in relation to the sitting position, as well as to comfortably get up from said position to remain standing between the chair and the desk.

STATE OF THE ART

The embodiment of chairs with a rotating support so that the user can orient his position in any direction remaining seated is known; and the embodiment of supporting elements which support the chairs provided with rolling supports, to allow movements to different working positions while sitting on the corresponding chair, is also known.

These embodiments are suitable for applications in which the chairs are arranged in a space allowing movements, but there are applications in which, due to limitation of the space or due to the type of installation, the chairs must remain in a stationary anchoring arrangement, which is a problem when dealing with the arrangement of the chairs positioned at a work desk, since the necessary proximity of the chair in relation to the desk, in order for there to be a suitable position for working on the desk while sitting, makes it very difficult and uncomfortable to stand up, as well as to enter and exit in relation to the sitting position.

OBJECT OF THE INVENTION

According to the invention, a supporting foot for chairs is proposed, which is provided with constructive and functional features allowing the movement of the body of the chair on a stationary anchoring arrangement, overcoming the drawbacks of access and standing of the users in the installation of the chair positioned at a corresponding work desk.

This foot object of the invention consists of a column provided with an anchor for securing same to the ground, including, according to a conventional rotating assembly arrangement, an upper supporting element for securing the body of the chair, in which supporting element there is included a carriage which can move in a longitudinal movement, on which carriage the body of the chair is secured.

An assembly is thus obtained which allows the rotation of the chair on the supporting column secured to the ground, and which furthermore, by means of the arrangement of the assembly on the supporting element for securing the body of the chair, also allows a backward movement of the body of the chair in relation to the supporting column.

With said rotation and movement arrangement, the body of the chair can move such that in a stationary anchoring installation of the chair in front of a work desk, the user can access and exit comfortably and without difficulty in relation to the sitting position at the desk. And likewise, the movement of the body of the chair allows the user to get up from the sitting position, in order to stand vertically between the chair and the desk.

The proposed foot therefore provides a satisfactory solution so that the users can move about easily and comfortably between a chair and a desk facing one another and in a stationary anchoring arrangement.

The arrangement of the mobile assembly of the body of the chair on the supporting foot is nevertheless provided with springs for the return, both in rotation and in movement, to the facing and proximity position in relation to the desk of application; such that the body of the chair thus returns automatically to the "zero" or use position, thus facilitating the positioning for the use functions.

Said foot object of the invention therefore has truly advantageous features, acquiring its own identity and a preferred character for the arrangement of the installation of chairs positioned at desks for which it is intended.

DETAILED DESCRIPTION OF THE INVENTION

The object of the invention relates to a foot intended for supporting chairs in a stationary anchoring arrangement positioned at corresponding work desks, with features allowing the mobility of the body of the chair in relation to the supporting foot, to make it easier for the user to move about between the chair and the respective desk.

The proposed foot consists of a column (1) provided with a lower anchor (2) for securing same on the ground, while it includes in a conventional rotating assembly an upper supporting element (3) intended for securing the body of the chair (13) of application.

Figure 1:
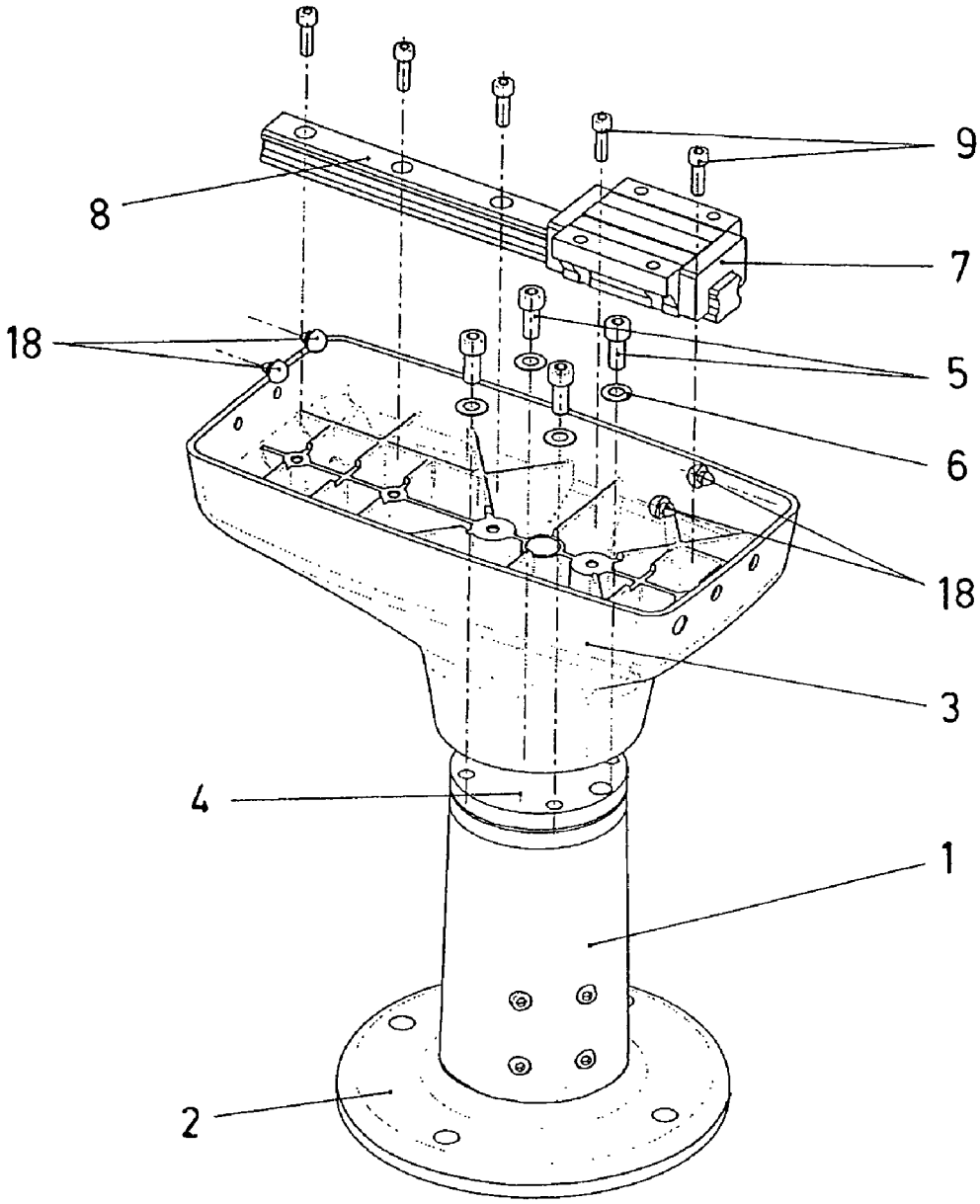
FIG. 1 shows an exploded perspective view of the proposed supporting foot for chairs.
Figure 2:
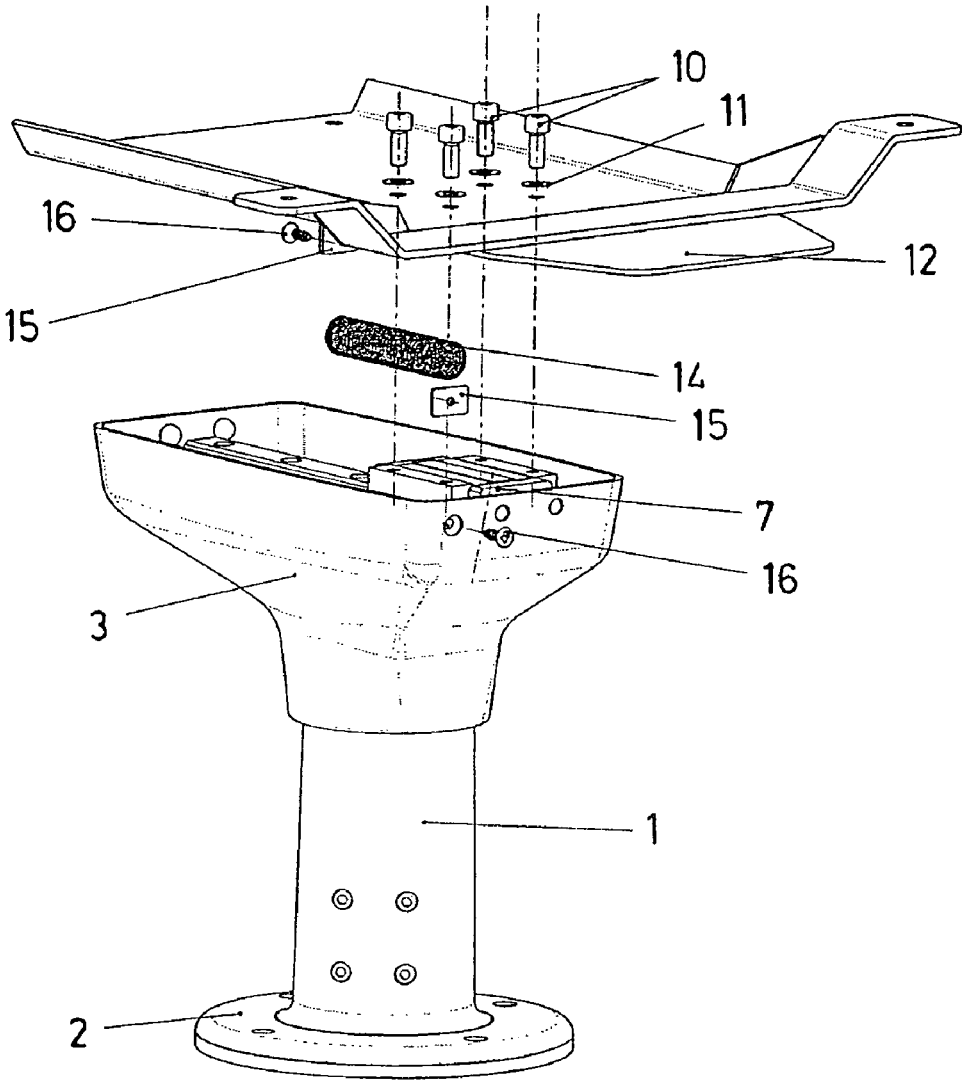
FIG. 2 is an exploded perspective view of the assembly between the supporting foot and the securing structure for securing the body of the corresponding chair, according to an embodiment.
Figure 3:
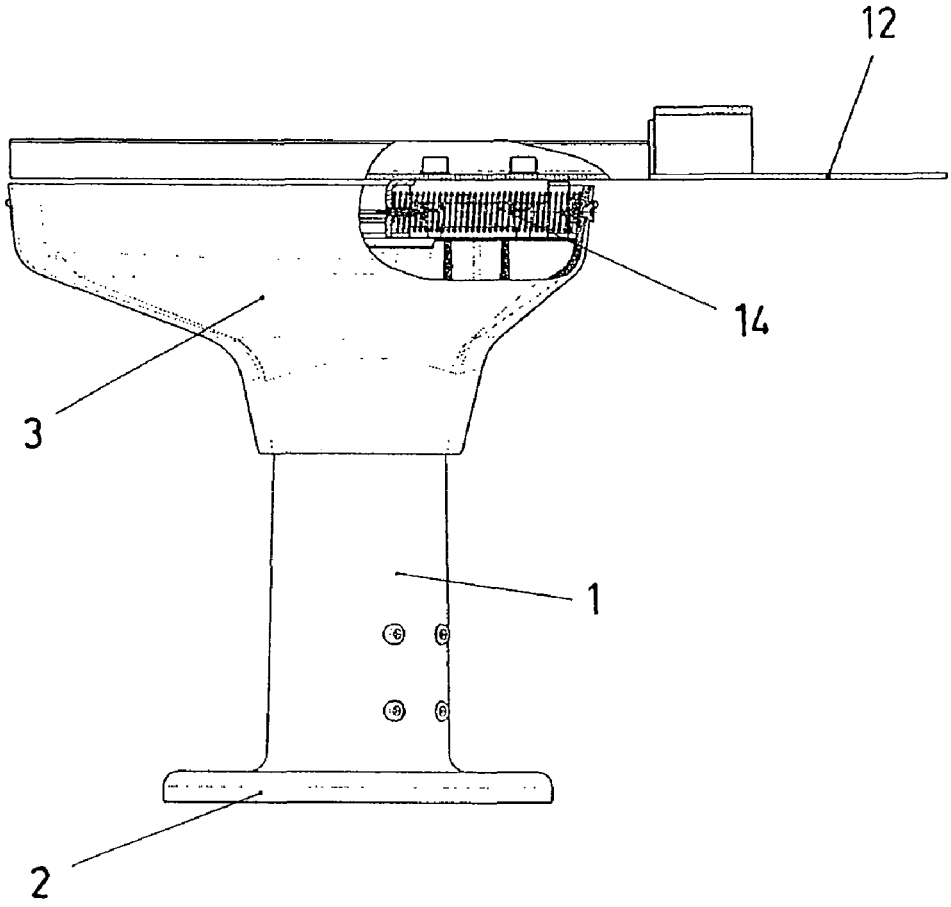
FIG. 3 is a side view of the previous assembly assembled, with the securing structure for securing the body of the chair in a forced movement position, a cut having been made to see the spring recovering the movement.

The rotating assembly of the supporting element (3) is established by means of a plate (4) which is included coupled with bearings at the upper end of the column (1), and on which the supporting element (3) is secured by means of fastening with screws (5) and washers (6), as observed in FIG. 1.

In the supporting element (3) there is arranged a carriage (7), included in an assembly capable of movement on a guide (8), which is secured with screws (9) in said supporting element (3).

Figure 8:
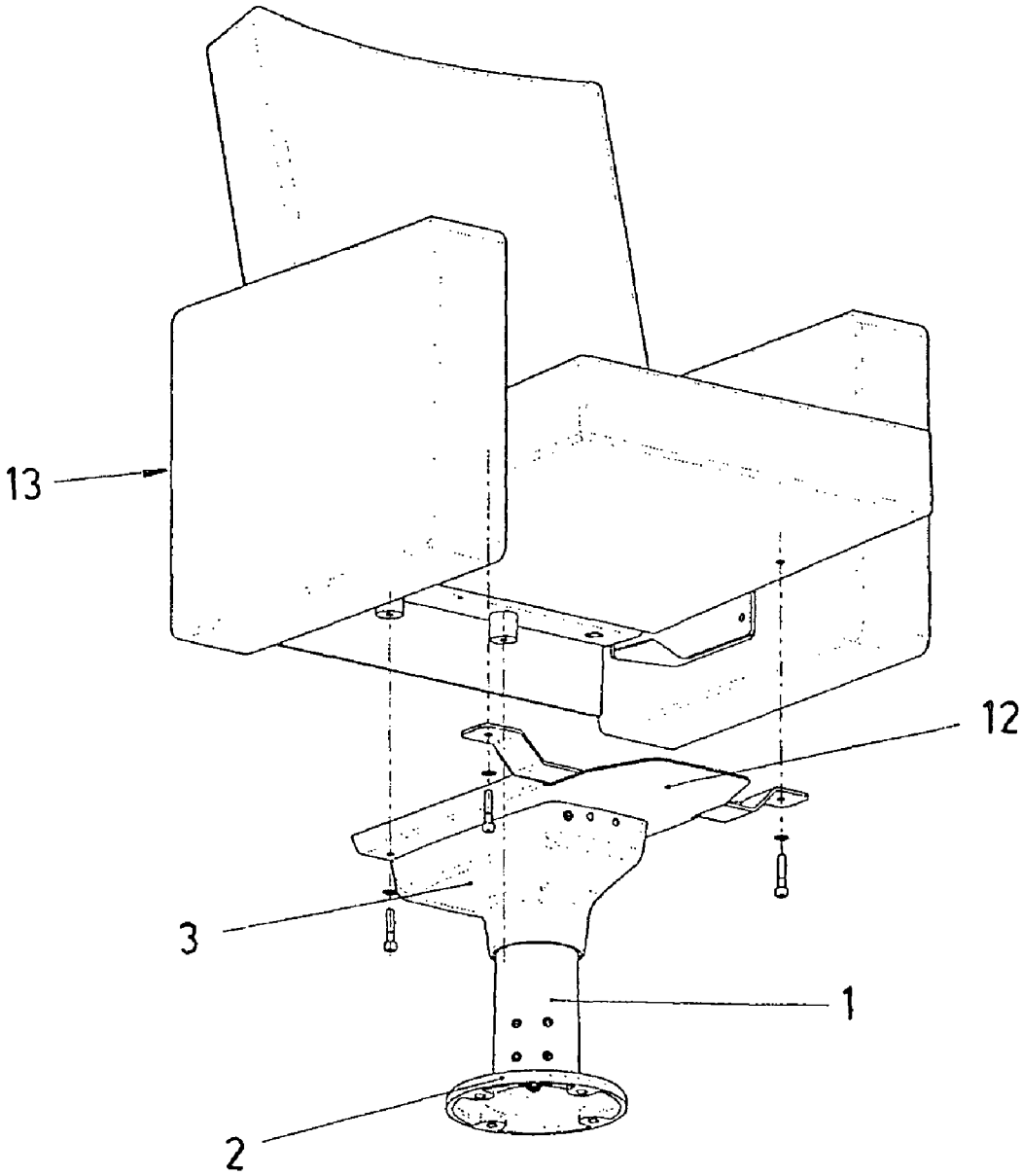
FIGS. 8, 9 and 10 depict an exploded perspective view of the securing of different types of chairs on the proposed foot.
Figure 9:
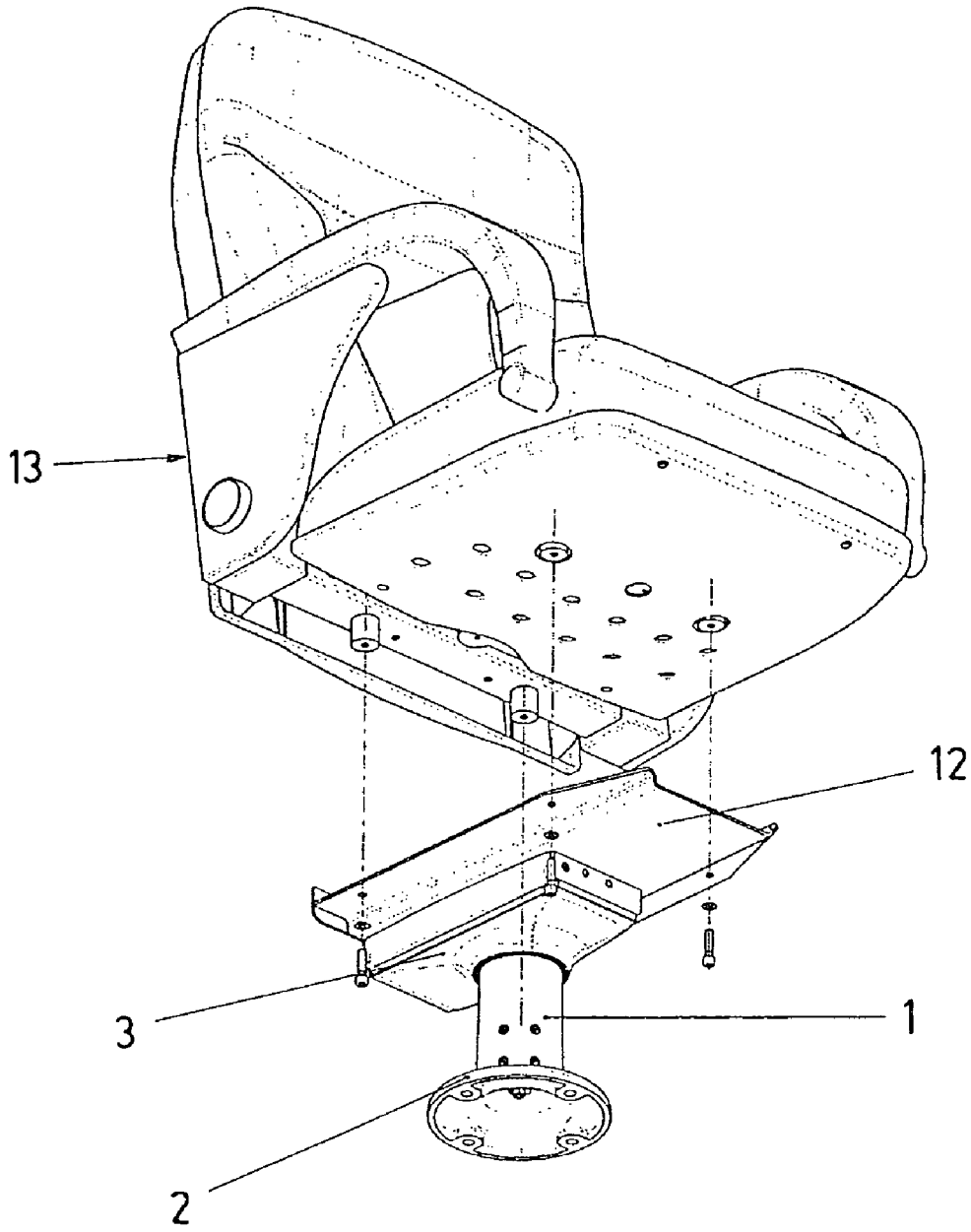
Figure 10:
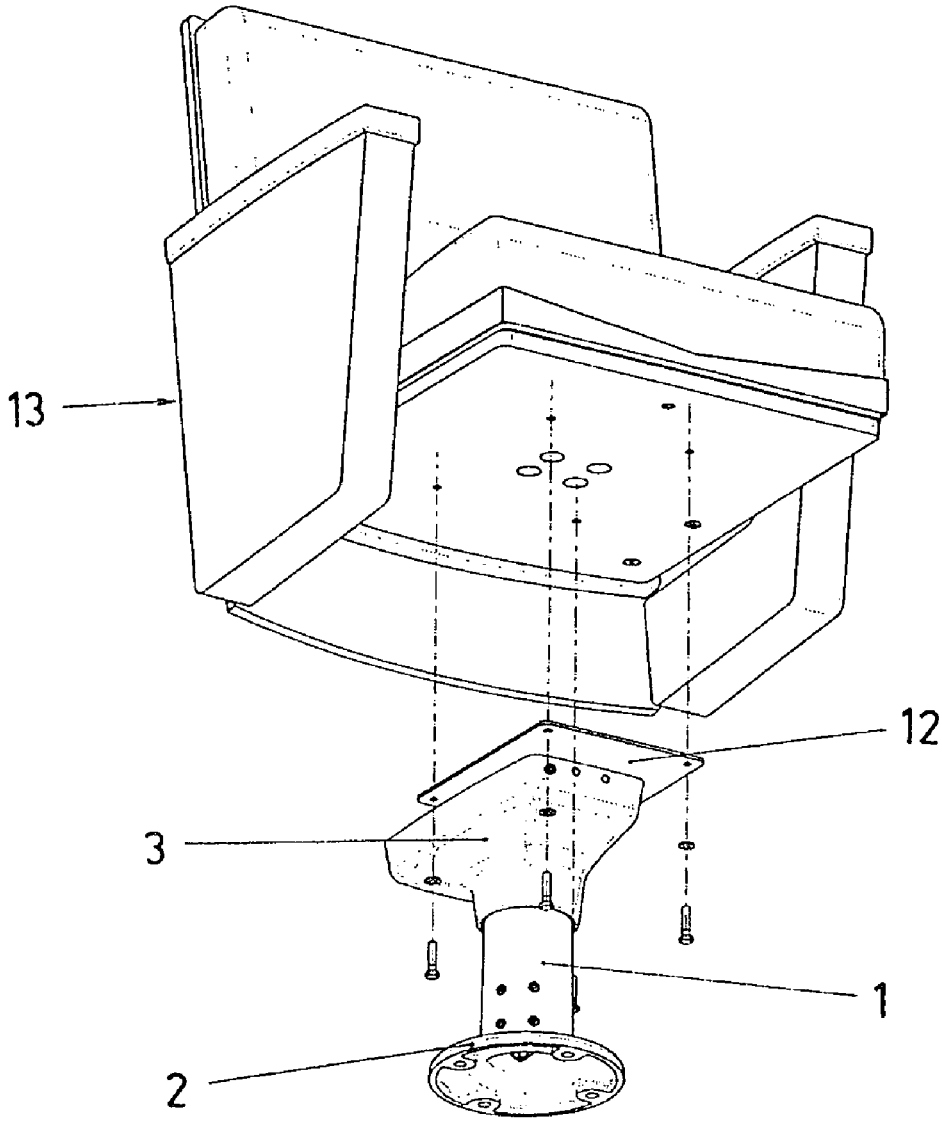
Figure 11:
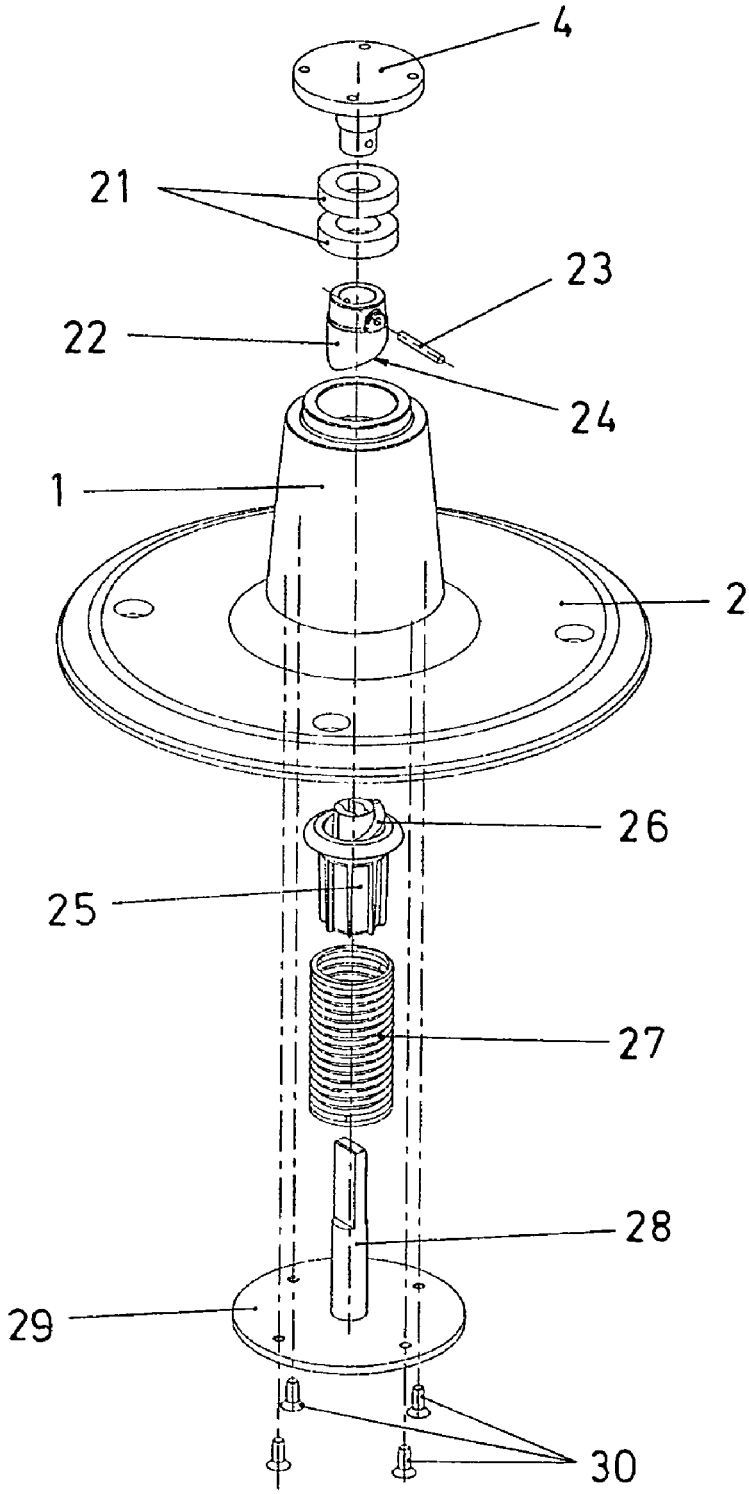
FIG. 11 depicts an exploded perspective view of the column of the proposed foot seen from above, with a solution for the automatic recovery of the rotation.
Figure 12:
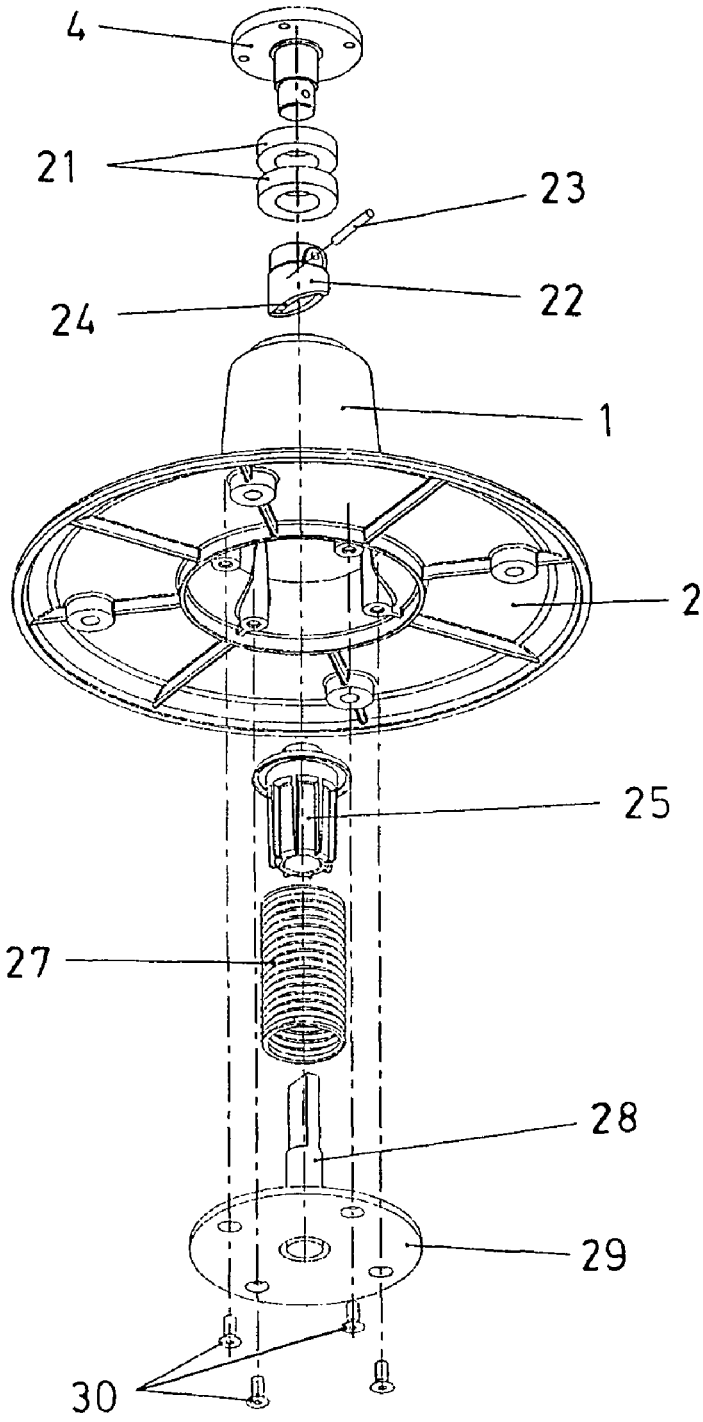
FIG. 12 is an exploded perspective view similar to the previous one but seen from below.

A structure (12) intended for securing the body of the corresponding chair (13) is secured on the carriage (7) by means of fastening with screws (10) and washers (11), which chair can be a chair of any type, as shown in FIGS. 8, 9 and 10, which depict different types of bodies of chairs (13), according to non-limiting examples. The securing structure (12) can likewise vary according to the type of body of the chair (13), as observed in the same FIGS. 8, 9 and 10.

Between the casing of the supporting element (3) and the securing structure (12) for securing the body of the chair (13), there is included parallel to the guide (8) for the movement of the carriage (7), a pushing spring (14) assembled between sheets (15) which are secured by means of corresponding screws (16).

Figure 4:
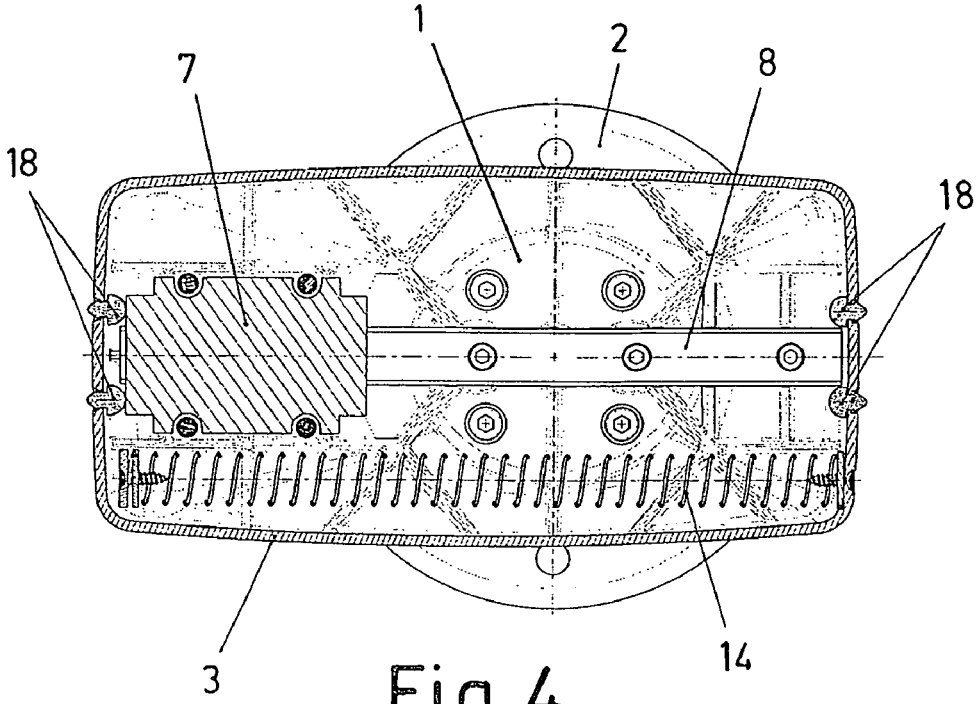
FIG. 4 is an enlarged plan view of the foot, with the carriage for securing the body of the chair in the normal position.
Figure 5:
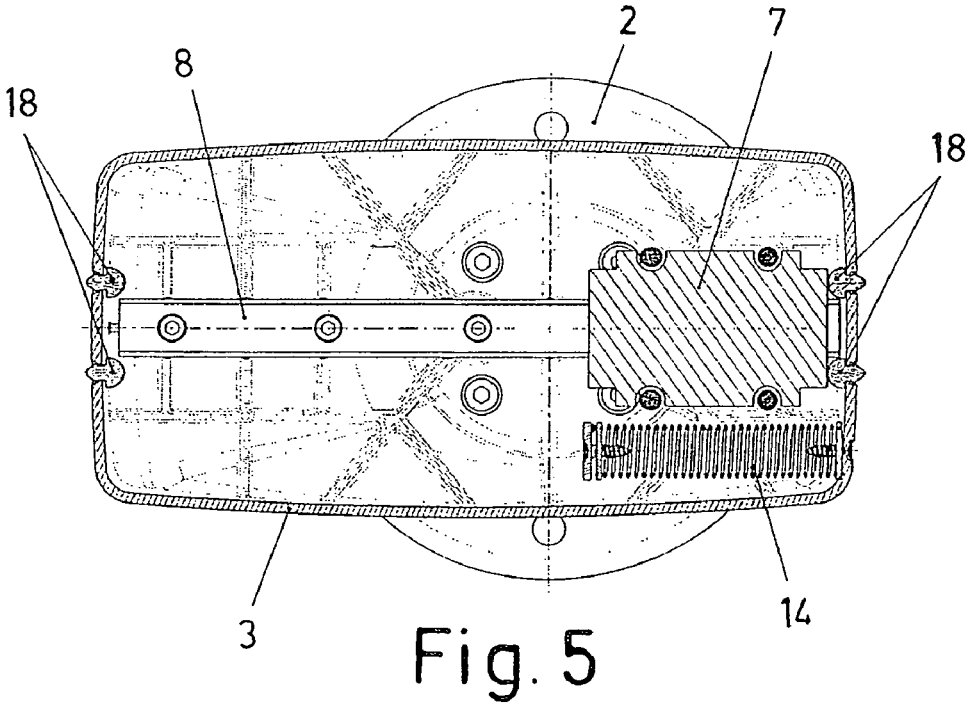
FIG. 5 is a plan view of the foot, with the carriage for securing the body of the chair in the forced movement position.

With such arrangement, the supporting element (3) can rotate in relation to the column (1) by means of the plate (4), whereas the carriage (7) can move along the guide (8) of the supporting element (3) between respective end positions, as shown in FIGS. 4 and 5; which involves a mobility of the body of the chair (13) in rotation and movement on the column (1).

Figure 6:
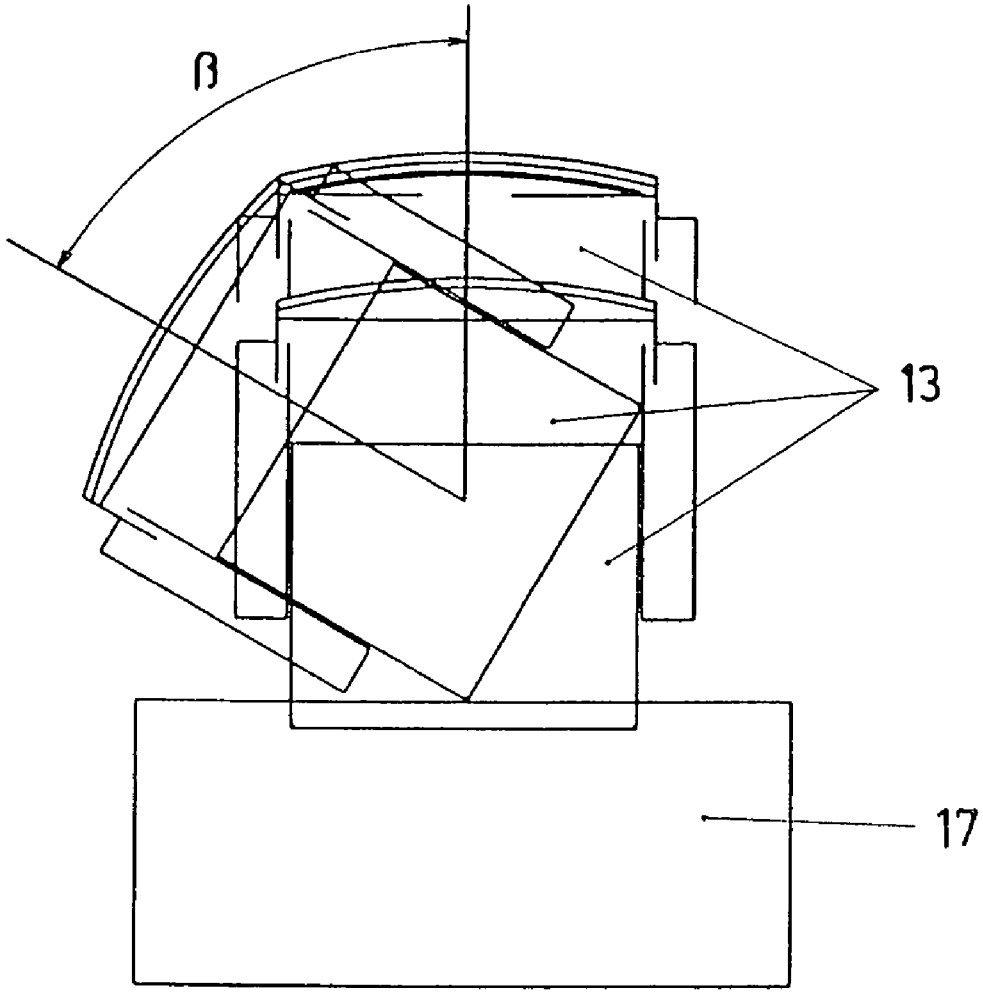
FIG. 6 is a diagram in plan view of the movements of the body of a chair in relation to a desk arranged facing it, according to the invention.

This allows the installation of the supporting foot in a stationary anchoring arrangement on the ground in order to arrange a chair (13) positioned at a corresponding work desk (17), such that with the supporting foot remaining static on the stationary anchor in that arrangement, the body of the chair (13) can rotate and move backwards, as observed in FIG. 6, which allows the user to be able to enter and exit easily in relation to the sitting position at the desk (17).

The spring (14) which is arranged in the supporting element (3) tends to move the securing structure (12) for securing the body of the chair (13) in the direction of approach of said body of the chair (13) towards the facing desk (17), whereby in the normal conditions the body of the chair (13) is close to the desk (17) in the suitable position for working on it from the sitting position, being able to force the movement of the mentioned body of the chair (13) backwards by means of a simple push overcoming the action of the spring (14).

To prevent abrupt blows of the carriage (7) against the casing of the supporting element (3), elastic stops (18) are arranged in the end walls of said casing of the supporting element (3), against which stops (18) the carriage (7) collides such that its blows are cushioned.

Likewise, in a preferred embodiment, the rotating assembly of the supporting element (3) on the column (1) of the supporting foot is provided in turn with elastic recovery towards a position, which in the assembly of application of the supporting foot is made to coincide with the orientation of the body of the chair (13) towards the respective desk (17), said rotating assembly being established with limitation of the rotation in an angle (β) of 60°, for example, towards each of the sides.

In that sense, the column (1) of the supporting foot is provided, as observed in FIGS. 11 to 14, with a mechanism associated to the plate (4) of the upper part which is arranged in a rotating assembly by means of bearings (21), said mechanism comprising a cam (22) which is associated in rotation with the mentioned plate (4) by means of a transverse pin (23), and which determines at the lower part a helical track (24), whereas supported in that lower part of said cam (22) there is arranged another cam (25) provided with a reciprocal helical track (26) and which is pushed upwards by a spring (27), this lower connecting rod (25) being assembled with axial freedom but with blocked rotation in relation to a rod (28) integral with a plate (29) which is secured by means of screws (30) at the lower part of the column (1).

Figure 13:
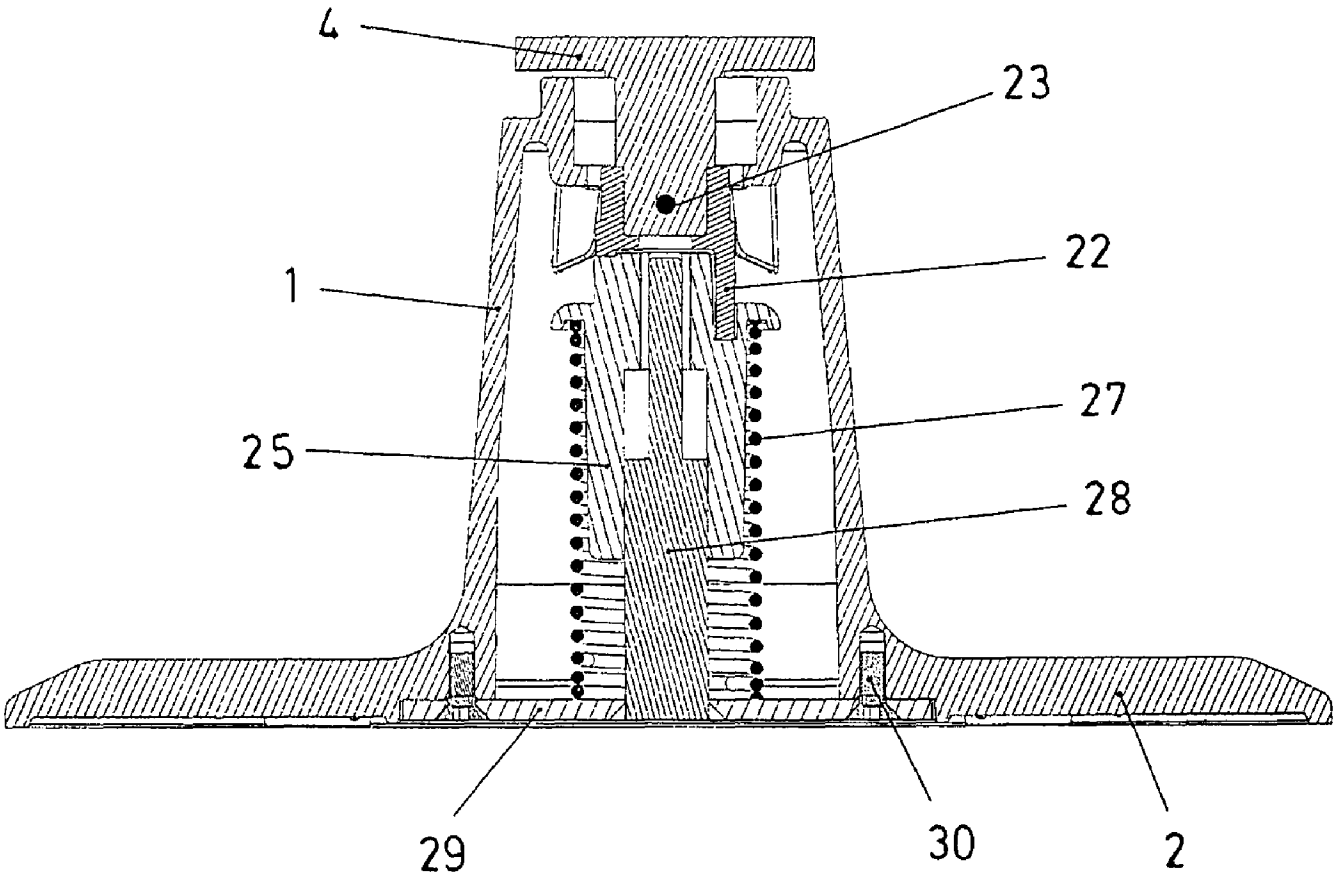
FIG. 13 is a diametric section view of the column of the foot provided with the solution for the automatic recovery of the rotation, in the stable position of the recovering mechanism.

Thus, in normal conditions, as a result of the push of the spring (27) the cam (25) forces the cam (22) and with it, by means of the plate (4), the entire assembly supporting the chair of application, to a stable position such as the one depicted in FIG. 13, which can be established corresponding with the chair of application arranged facing the respective desk.

Figure 14:
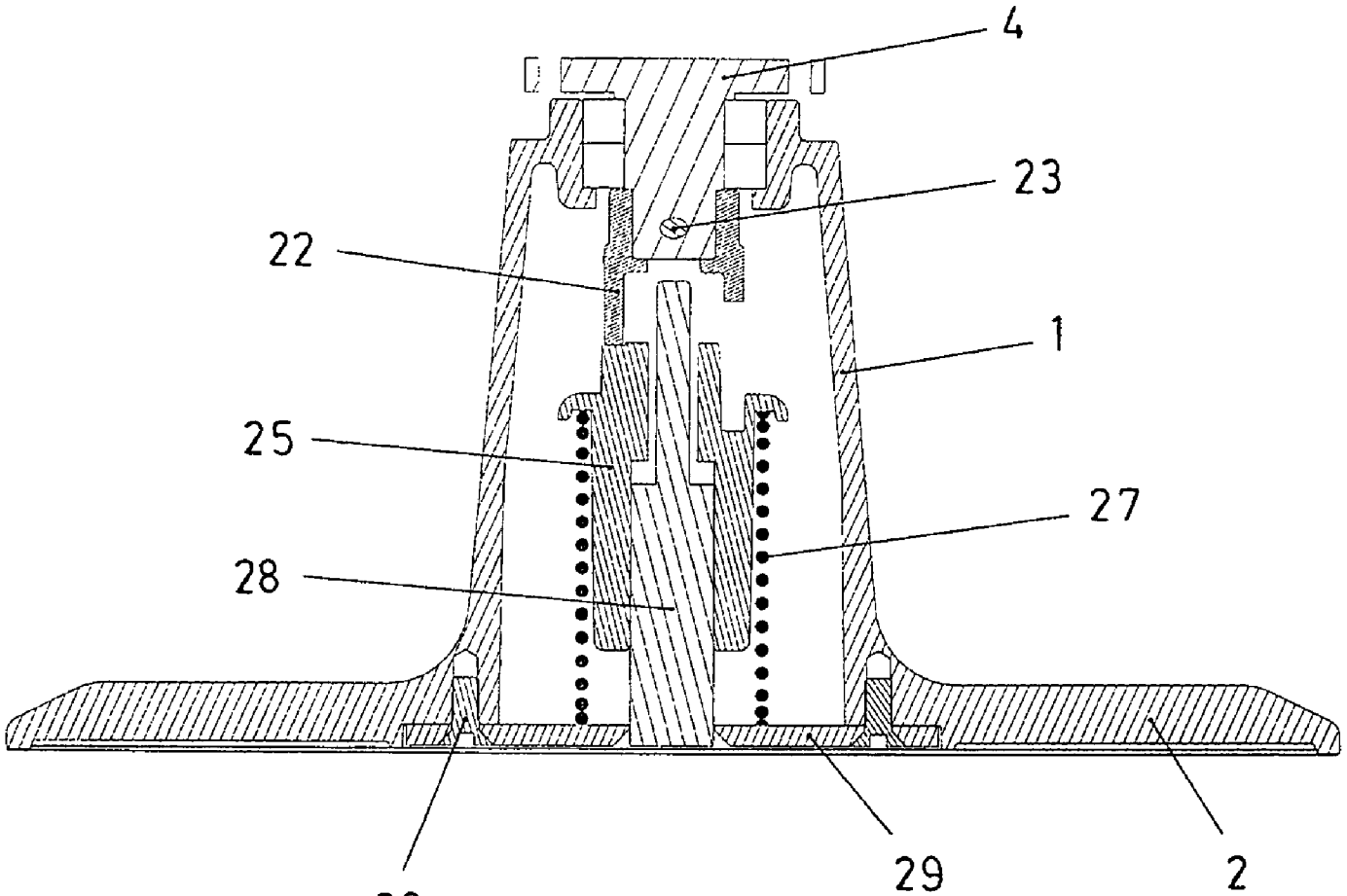
FIG. 14 is a section like that of the previous figure in a forced position of the recovering mechanism.

If from said position the supported chair is forced to rotate towards a side, the relation between the cams (22) and (25), by means of their helical tracks (24) and (26), forces the lower cam (25) to move downwards against the spring (27), as observed in FIG. 14, whereby there is a load tending to return the assembly to the initial position by the push of the spring (27), said initial position being automatically recovered when the force which obliges the rotation of the supported chair ceases.

Thus, due to the action of the spring (14) and due to the elastic recovery of the rotating assembly, there is established an automatic return of the body of the chair (13) to the position referred to as "zero" or starting position, in which the body of the chair (13) is in the suitable position in relation to the desks (17) to work on the latter.

Figure 7:
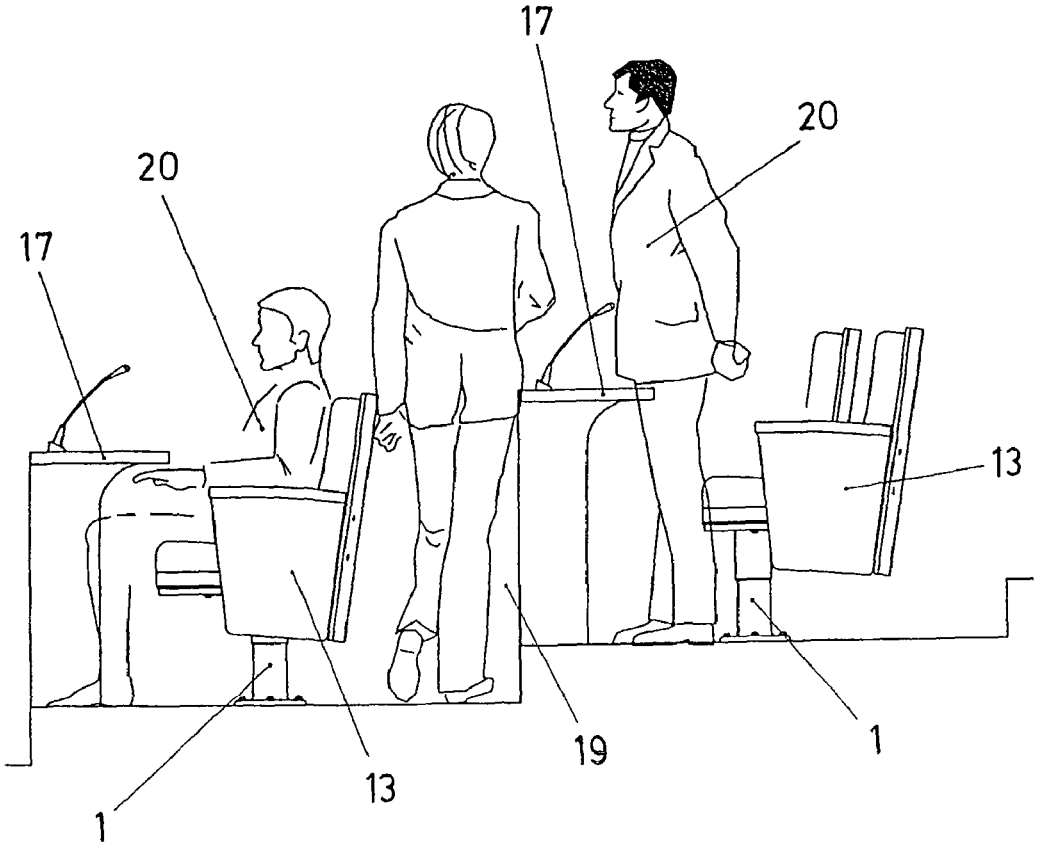
FIG. 7 is a schematic example of an installation of chairs facing desks, indicating the sitting and standing user positions.

The support of the body of the chair (13) in these conditions allows the application in distributions of successive rows of chairs with facing desks (17), for example for halls for conferences or similar activities, as observed in FIG. 7, such that in normal conditions the bodies of the chairs (13) are in the suitable position at the corresponding desks (17) to work on the latter, leaving a free space (19) behind them which serves as a passage to be able to walk, said space (19) allowing the movement of the bodies of the chair (13) so that users (20) can access and exit in relation to the sitting position, as explained above.

The backward movement of the bodies of the chair (13), in those conditions, also allows, as observed in this same FIG. 7, any user (20) to be able to get up from the sitting position and remain standing in a vertical position between the body of the chair (13) and the respective desk (17), since as a result of the backward movement of the body of the chair (13) when pushed by the legs of the user (20), the space necessary for the user (20) to be able to stand is vertically clear.

The invention claimed is:

1. A stationary anchoring foot for chairs positioned at desks of the type intended to support a chair with mobility in relation to a corresponding work desk, comprising:

a column provided with a lower anchor for securing same on the ground, while it includes by means of rotating coupling an upper supporting element intended for securing the body of the chair to be supported, there being in said supporting element a carriage which can move longitudinally along a guide, in relation to which carriage the body of the chair is secured, which body can thus move with the mentioned carriage backwards and in rotation in relation to the stationary column between respective positions allowing the approach and separation in relation to the corresponding work desk, characterized in that the mobile assembly of the body of the chair by means of the carriage in the supporting element is arranged with a pushing spring tending to place the mentioned mobile assembly in an end position of the movement, it being necessary to push against said spring to take the mobile assembly towards the other end of the movement.

2. The stationary anchoring foot for chairs positioned at desks according to claim 1, characterized in that the action of the pushing spring establishes an automatic return of the body of the chair to its proximity position in relation to the corresponding work desk.

3. The stationary anchoring foot for chairs positioned at desks according to claim 1, characterized in that elastic stops (18) are arranged in the end walls of the casing of the supporting element, against which stops the carriage collides in the movements.

4. The stationary anchoring foot for chairs positioned at desks according to claim 1, characterized in that the action of the pushing spring establishes an automatic return of the body of the chair to its proximity position in relation to the corresponding work desk.

5. A stationary anchoring foot for chairs positioned at desks of the type intended to support a chair with mobility in relation to a corresponding work desk, comprising:

a column provided with a lower anchor for securing same on the ground, while it includes by means of rotating coupling an upper supporting element intended for securing the body of the chair to be supported, there being in said supporting element a carriage which can move longitudinally along a guide, in relation to which carriage the body of the chair is secured, which body can thus move with the mentioned carriage backwards and in rotation in relation to the stationary column between respective positions allowing the approach and separation in relation to the corresponding work desk, characterized in that elastic stops are arranged in the end walls of the casing of the supporting element, against which stops the carriage collides in the movements.

6. A stationary anchoring foot for chairs positioned at desks of the type intended to support a chair with mobility in relation to a corresponding work desk, comprising:

a column provided with a lower anchor for securing same on the ground, while it includes by means of rotating coupling an upper supporting element intended for securing the body of the chair to be supported, there being in said supporting element a carriage which can move longitudinally along a guide, in relation to which carriage the body of the chair is secured, which body can thus move with the mentioned carriage backwards and in rotation in relation to the stationary column between respective positions allowing the approach and separation in relation to the corresponding work desk, characterized in that the supporting element is assembled on the column by means of a plate including a cam associated in integral rotation therewith, in relation to which cam there is another facing cam supported at the lower part by means of corresponding helical tracks, which cam is assembled with axial freedom but with blocked rotation in relation to a stationary rod, this connecting rod being pushed upwards by a spring, the force of which determines a rotating recovery of the support of the chair of application to a stable position.

* * * * *